US011453981B2

(12) United States Patent
Pritzl et al.

(10) Patent No.: US 11,453,981 B2
(45) Date of Patent: Sep. 27, 2022

(54) RAIL PLATE RETAINER WITH STABILIZED GRIPPING JAWS FOR USE WITH RAIL TIE EXCHANGER

(71) Applicant: NORDCO INC., Oak Creek, WI (US)

(72) Inventors: Patrick Joseph Pritzl, Franksville, WI (US); Kyle Matthew Neubauer, Greenfield, WI (US); Gregory John Long, Mount Pleasant, WI (US); Ryan Matthew Holschbach, Mukwonago, WI (US); James W. Boyd, New Berlin, WI (US)

(73) Assignee: NORDCO INC., Oak Creek, WI (US)

( * ) Notice: Subject to any disclaimer, the term of this patent is extended or adjusted under 35 U.S.C. 154(b) by 307 days.

(21) Appl. No.: 16/660,629

(22) Filed: Oct. 22, 2019

(65) Prior Publication Data

US 2020/0131716 A1 Apr. 30, 2020

Related U.S. Application Data

(60) Provisional application No. 62/751,319, filed on Oct. 26, 2018.

(51) Int. Cl.
*E01B 29/32* (2006.01)
*E01B 29/10* (2006.01)

(52) U.S. Cl.
CPC ..... *E01B 29/32* (2013.01); *E01B 29/10* (2013.01)

(58) Field of Classification Search
CPC ..... E01B 29/06; E01B 29/09; E01B 29/10; E01B 29/32; E01B 27/04; E01B 27/06
USPC ..... 104/9
See application file for complete search history.

(56) References Cited

U.S. PATENT DOCUMENTS 4,809,614 A * 3/1989 Theurer ..... E01B 29/10 104/12
4,862,806 A * 9/1989 Theurer ..... E01B 29/09 104/7.2
4,955,301 A * 9/1990 Theurer ..... E01B 29/10 104/7.2
5,046,270 A * 9/1991 Theurer ..... E01B 27/06 37/104
5,074,219 A * 12/1991 Theurer ..... E01B 29/32 104/17.2

(Continued)

FOREIGN PATENT DOCUMENTS

DE 2230202 B1 * 8/1973 ..... E01B 27/04

*Primary Examiner* — Zachary L Kuhfuss
(74) *Attorney, Agent, or Firm* — Greer, Burns & Crain, Ltd

(57) ABSTRACT

A rail tie plate retaining workhead is provided for use in conjunction with a rail tie replacement machine moving along a railroad track having a pair of rails. The workhead includes a workhead frame configured for movement along the track relative to the rail tie replacement machine, and a pair of plate retaining frames, each frame associated with a respective one of the rails, and being connected to the workhead frame. Each plate retaining frame has at least one rail guide wheel connected to the retaining frame using a fluid powered cylinder, the wheels vertically reciprocating between an extended position, in which the workhead is raised to a travel position, and a retracted position, in which the workhead is lowered to a working position in operational relationship with at least one targeted rail tie plate.

15 Claims, 9 Drawing Sheets

(56) References Cited

U.S. PATENT DOCUMENTS

| | | | | | |
|---|---|---|---|---|---|
| 5,117,760 | A * | 6/1992 | Almaraz | E01B 29/32 | 104/17.2 |
| 5,125,345 | A * | 6/1992 | Theurer | E01B 29/10 | 104/9 |
| 5,193,461 | A * | 3/1993 | Theurer | E01B 29/10 | 104/7.1 |
| 5,467,717 | A * | 11/1995 | Theurer | E01B 29/10 | 104/6 |
| 5,617,795 | A * | 4/1997 | Glomski | E01B 29/10 | 104/9 |
| 6,463,858 | B2 | 10/2002 | Weber et al. | | |
| 6,536,354 | B1 * | 3/2003 | Madison | E01B 27/04 | 104/2 |
| 6,755,135 | B2 | 6/2004 | Johnsen et al. | | |
| 6,863,717 | B2 | 3/2005 | Johnsen et al. | | |
| 7,926,426 | B2 * | 4/2011 | Sperling | E01B 29/26 | 104/279 |
| 8,522,688 | B2 * | 9/2013 | Pritzl | E01B 29/32 | 104/17.2 |
| 9,777,439 | B2 | 10/2017 | Irion | | |
| 10,081,917 | B2 | 9/2018 | Irion et al. | | |
| 2011/0308421 | A1 * | 12/2011 | Pritzl | E01B 29/32 | 104/17.2 |

* cited by examiner

RAIL PLATE RETAINER WITH STABILIZED GRIPPING JAWS FOR USE WITH RAIL TIE EXCHANGER

RELATED APPLICATION

This application is a Non-Provisional of, and claims 35 USC 119 priority from, U.S. Provisional Application Ser. No. 62/751,319 filed Oct. 26, 2018, the contents of which are incorporated by reference.

BACKGROUND

This invention relates generally to railway right-of-way maintenance equipment of the type used to repair and maintain railroad track. More specifically, the present invention relates to an apparatus for handling rail tie plates during replacement of rail ties.

Conventional railroad track consists of a plurality of spaced parallel wooden ties, to which are attached a pair of spaced rail tie plates. Each tie plate is configured to rest on the upper surface of the tie and includes holes for receiving spikes or screws, as well as a canted seat or a cradle formation for receiving the bottom or foot of the steel rail. Since two rails make up a railroad track, there are a pair of spaced tie plates on each tie. Some of the spikes are used to secure the tie plate on the tie, and others are used to secure the rail foot to the tie plate cradle.

During track maintenance operations, it is common to periodically remove worn out or rotten ties. This is accomplished by first removing the spikes which hold the plates to the tie as well as to the rail. Next, a machine, such as is disclosed in commonly-assigned U.S. Pat. No. 6,463,858, incorporated by reference, lifts the rail and extracts the worn tie from underneath. The tie is slid transversely out from beneath the rails. As the tie is extracted, the loosened tie plates either fall into the rail bed or ballast, or are retained on the removed tie. Conventional practice is to manually remove the plates and then throw them off to the side of the ballast so they do not interfere with the replacement procedure of the new tie.

One system for handling the plates automatically during the tie replacement process is disclosed in commonly-assigned U.S. Pat. No. 6,863,717 which is incorporated by reference. Using this machine, the tie plates are grasped at the forward and rear edges with respect to the direction of travel along the track and are held suspended above the rails while the tie is extracted.

Another approach to the problem of tie plate handling is disclosed in U.S. Pat. No. 5,722,325. In this machine, the tie plates are grasped and held to the rail while the tie is extracted. A pair of jaws grasp the target tie plate along the forward and rear side edges with respect to the direction of travel on the track. A fluid-powered, preferably hydraulic cylinder is connected to both jaws to exert the gripping force. In practice, this apparatus has encountered difficulty in centering the force on the target plate, which has interfered with efficient plate handling. Also, the mechanism disclosed in the '325 patent has proved difficult to use when the tie plates are not aligned on the tie, which often occurs in lengths of curved track, or when ties are subject to warping.

Another tie plate handling apparatus is disclosed in U.S. Pat. No. 5,722,325. Gripper jaws engage forward and rear edges of the tie plates and grasp the plates in place and hold the plate against the rail while the tie is removed. Pairs of gripper jaws are provided on both the field side and the gauge side of the rail. Tie removal is in a transverse direction to the action of the plate gripper jaws. A single fluid power cylinder operates each pair of jaws, with one jaw each connected respectively to the rod and blind end of the cylinder. A spring arrangement is provided for centering the opposing jaws, which move along a guide shaft. In practice, this apparatus has not met expectations for reliable centering of the plate.

Another aspect of the machine disclosed in the '325 patent is a horizontally oriented fluid powered cylinder connected to a scissors jack. This apparatus is used to vertically move the plate handling portion of the workhead relative to a main workhead frame between a raised, travel position, and a lowered, working position. The fluid powered cylinder reciprocates in a direction parallel to the ties and transverse to a longitudinal axis of the rails.

SUMMARY

The above-listed need is met or exceeded by the present rail plate retainer with stabilized gripping jaws for use with a rail tie exchanger. One feature is a workhead which is movable along the track relative to the rail tie exchanger. Included on the workhead is a pair of plate retaining frames, each of which has a pair of opposed rail tie plate gripping jaws configured for reciprocating along a direction parallel to the rails between a plate release position and a plate grabbing position. Each plate retaining frame has a pair of spaced, parallel guide shafts, and a pair of the jaws are slidable along the guide shafts between a plate release position and a plate grabbing position.

Another feature of the present workhead is that the plate retaining frame has at least one rail guide wheel connected to the retaining frame using a fluid powered cylinder. The wheels are vertically reciprocating between a lowered position, in which the workhead is raised to a travel position, and a raised position, in which the workhead is lowered to a working position in operational relationship with at least one targeted rail tie plate.

A further feature is a ballast scraper assembly mounted to the workhead frame for removing ballast from an upper surface of the rail tie being inserted into the track. The ballast scraper assembly includes four independently movable scraper blades mounted in two pairs. An LVDT is provided to the scraper assembly for adjusting a height set point of the blades relative to a bottom surface of a tie plate grasped in the gripping jaws. At the set point, the hydraulic cylinder for each scraper will go to high pressure, assisting the operator to install the top of the tie under the bottom surface of the tie plate.

Also provided is an improvement of the rail tie exchange machine, e form of a proximity switch associated with the reciprocating tie grabbing arm and beam assembly. Once the new tie has been inserted under the rails in the place occupied by the prior tie, the tie plate gripping jaws are closed, and the arm is retracted so that the jaws engage an end of the tie. The arm is retracted into the beam until a contact on the arm closes the proximity switch located on the beam. This process is initiated by the operator, but is automatically executed to maintain proper tie alignment on the track.

More specifically, a rail tie plate retaining workhead is provided for use in conjunction with a rail tie exchanger moving along a railroad track having a pair of rails. The workhead includes a workhead frame configured for movement along the track relative to the rail tie replacement machine, and a pair of plate retaining frames, each frame associated with a respective one of the rails, and being connected to the workhead frame. Each plate retaining frame having at least one rail guide wheel connected to the retaining frame using a fluid powered cylinder, the wheels vertically reciprocating between an extended position, in which the workhead is raised to a travel position, and a retracted position, in which the workhead is lowered to a working position in operational relationship with at least one targeted rail tie plate.

In another embodiment, a rail tie plate retaining workhead is provided for use in conjunction with a rail tie replacement machine moving along a railroad track having a pair of rails. The workhead includes a workhead frame configured for movement along the track relative to the rail tie replacement machine, a pair of plate retaining frames, each associated with a respective one of the rails, and being connected to the workhead frame. A pair of opposed rail tie plate gripping jaws are connected to each plate retaining frame, the jaws being configured for reciprocating along a direction parallel to the rails between a plate release position and a plate grabbing position, wherein each plate retaining frame has a pair of spaced, parallel guide shafts, and a pair of the jaws are slidable along the guide shafts between a plate release position and a plate grabbing position.

In still another embodiment, a rail tie replacement machine is provided that is configured for moving along a railroad track having a pair of rails, and includes a main frame having at least one wheel for engaging the rails, a hollow beam projecting transversely from the frame, and a reciprocating arm telescoping within the beam and moving transversely relative to the rails between an extended position and a retracted position. A pair of opposed rail tie clamps are located on a free end of the arm for engaging a rail tie, the tie clamps reciprocating between an open and a closed position under operator control. A proximity switch is associated with an end of the beam closest to the arm, and a contact for the proximity switch is located on the arm and dimensioned so that upon the tie clamps pushing a newly installed tie to a designated aligned position, the contact closes the proximity switch, alerting the operator that the new tie is in a proper position.

Associated with the machine is an operator controller connected to a fluid power cylinder connected to the reciprocating arm for moving the arm relative to the beam between the extended position and the retracted position, and upon the operator actuating the controller, the fluid power cylinder is constructed and arranged for retracting the arm, and the tie clamps, until the contact closes the proximity switch, for pushing the tie into the proper position.

DETAILED DESCRIPTION

Figure 1:
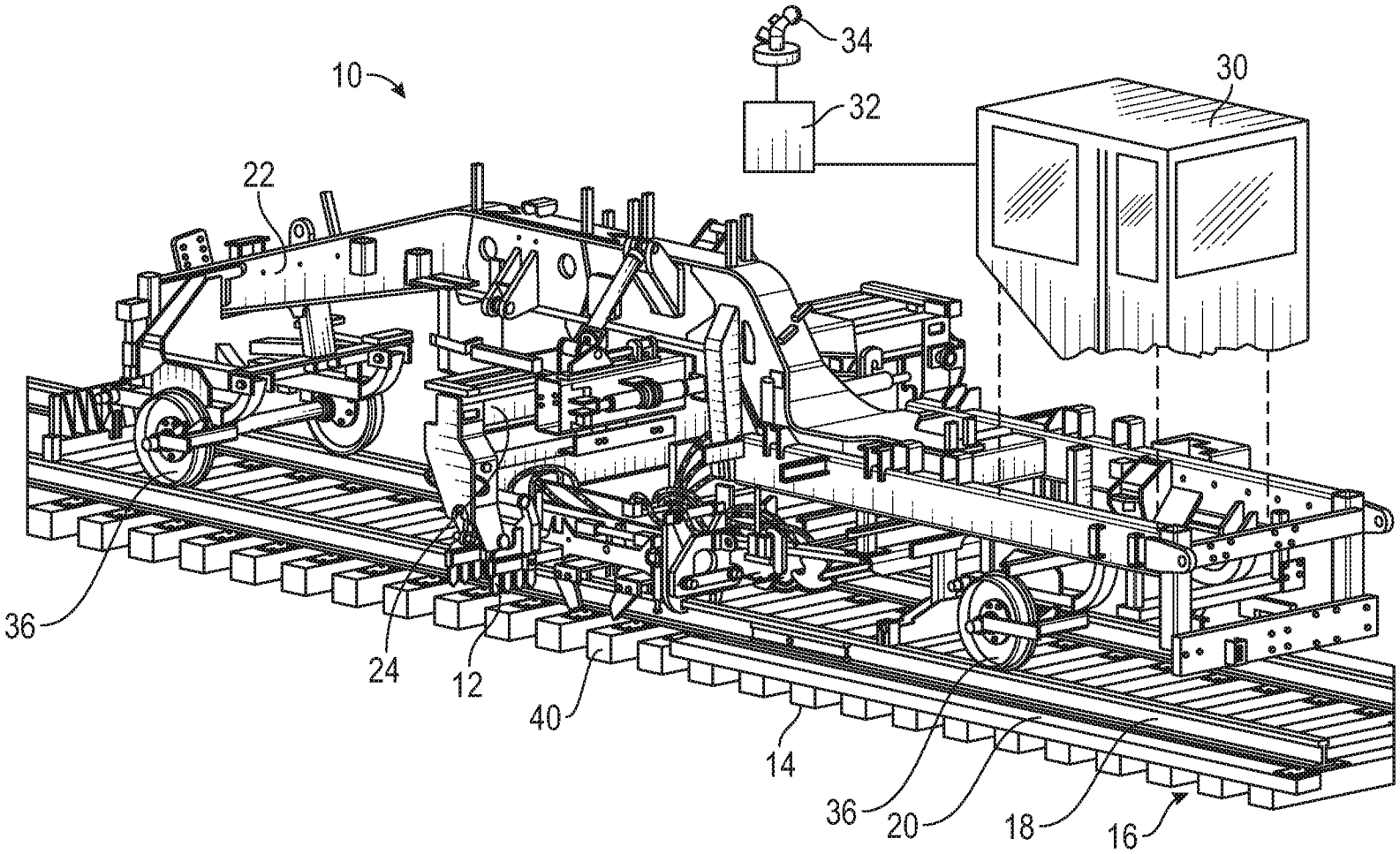
FIG. 1 is a fragmentary exploded, top perspective view of a rail tie exchanger machine equipped with the present tie plate retainer.
Figure 10:
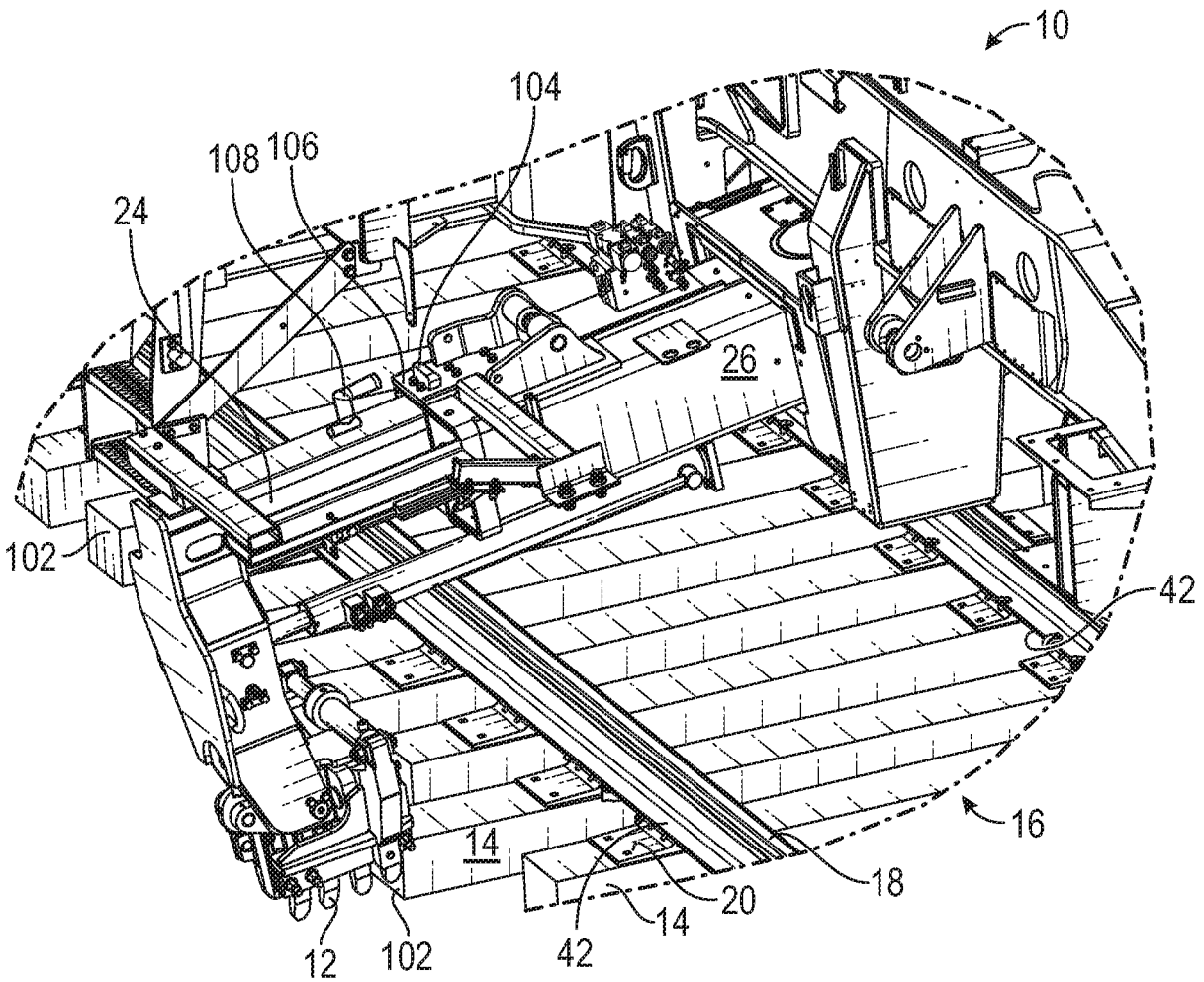
FIG. 10 is a fragmentary top perspective view of the rail tie exchanger machine of FIG. 1 with the new tie prior to alignment.
Figure 11:
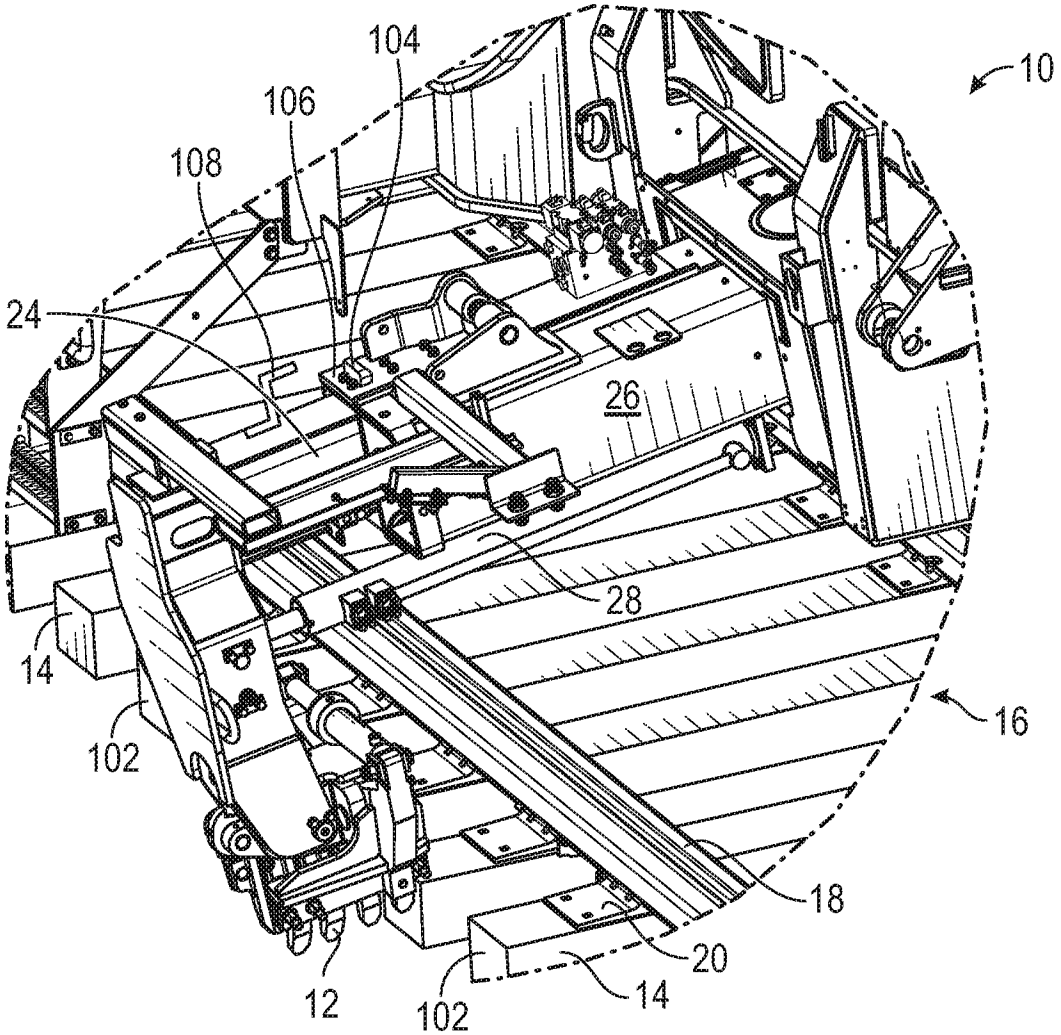
FIG. 11 is a fragmentary top perspective view of the rail tie exchanger machine of FIG. 1 with the new tie aligned after engagement by the tie gripping arm.

Referring now to FIGS. 1, 10 and 11, a rail tie exchanger or tie replacement machine suitable for use with the present plate retainer is generally designated 10. Features of the rail tie exchanger 10 are disclosed in commonly-assigned U.S. Pat. No. 6,463,858 which is incorporated by reference. As is known in the art, the tie exchanger 10 uses reciprocating tie gripper claws or clamps 12 to grasp a tie 14 of a railroad track 16. To grasp and move the rail ties 14, the claws 12 move between an open and a closed position. The track 16 includes a pair of rails 18, which are secured to the ties 14 with a pair of tie plates 20 on each tie. As is well known, the tie plates 20 are secured to the ties 14 with fasteners such as spikes or screws. These fasteners are removed prior to the tie extraction procedure using a separate spike remover apparatus well known to those in the art.

Also included on the tie exchanger 10 is a main frame 22 from which the gripper claws 12 are suspended via a telescoping arm 24 which reciprocates relative to a hollow beam 26 that projects transversely from the main frame and transversely relative to the rails 18. A fluid power cylinder 28 moves the arm 24 under operator control between an extended position and a retracted position.

An operator's cab 30 is attached to the main frame 22 and houses a control system 32 which as is well known in the art, includes at least one control interface 34 such as a joystick or the like. As is well known in the art, the tie exchanger 10 is preferably movable along the track 16 using a power source (not shown), such as an internal combustion engine, and is provided with flanged rail wheels 36 engaging the track 16.

Figure 2:
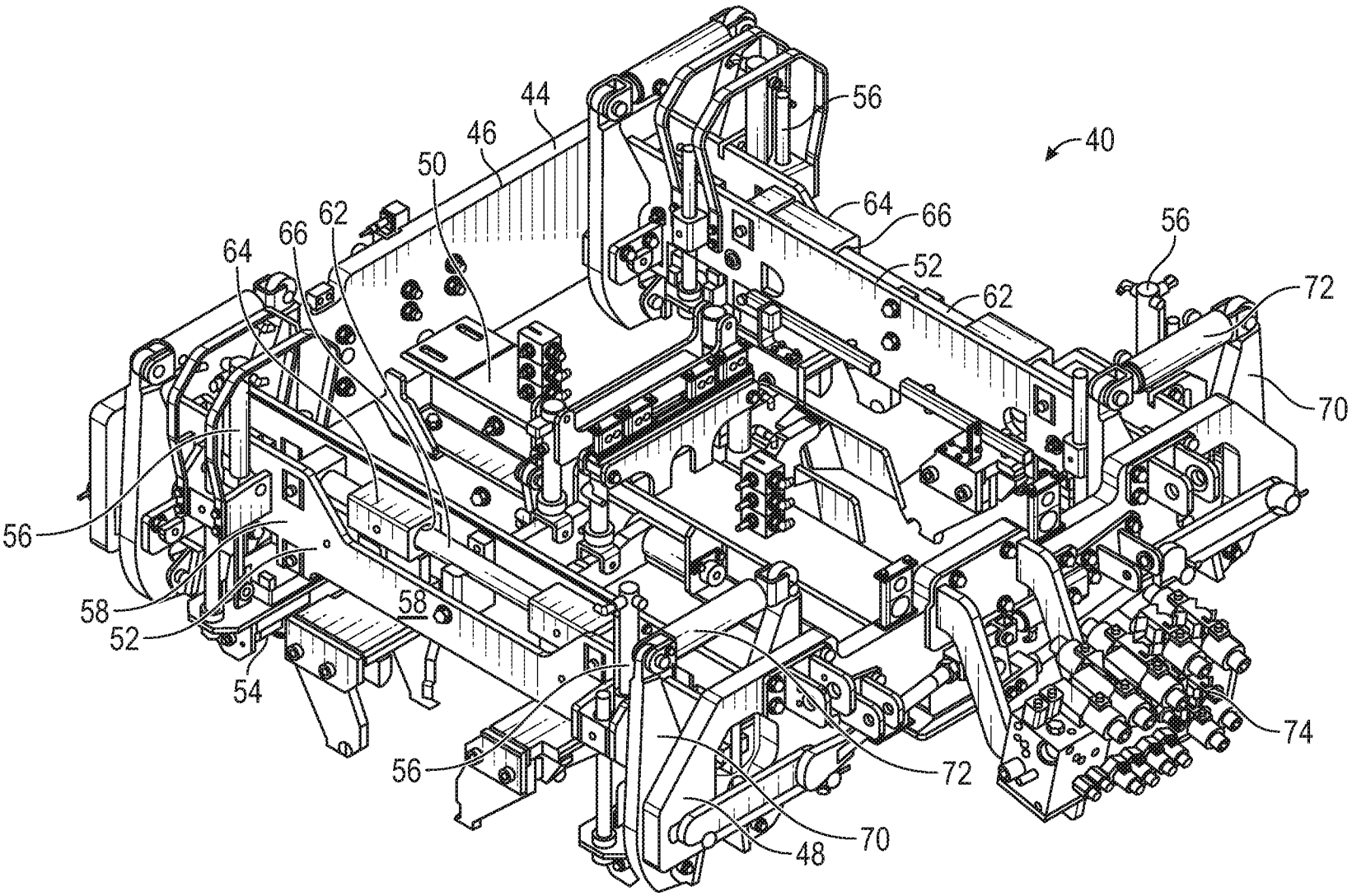
FIG. 2 is a fragmentary top perspective view of the present workhead.
Figure 3:
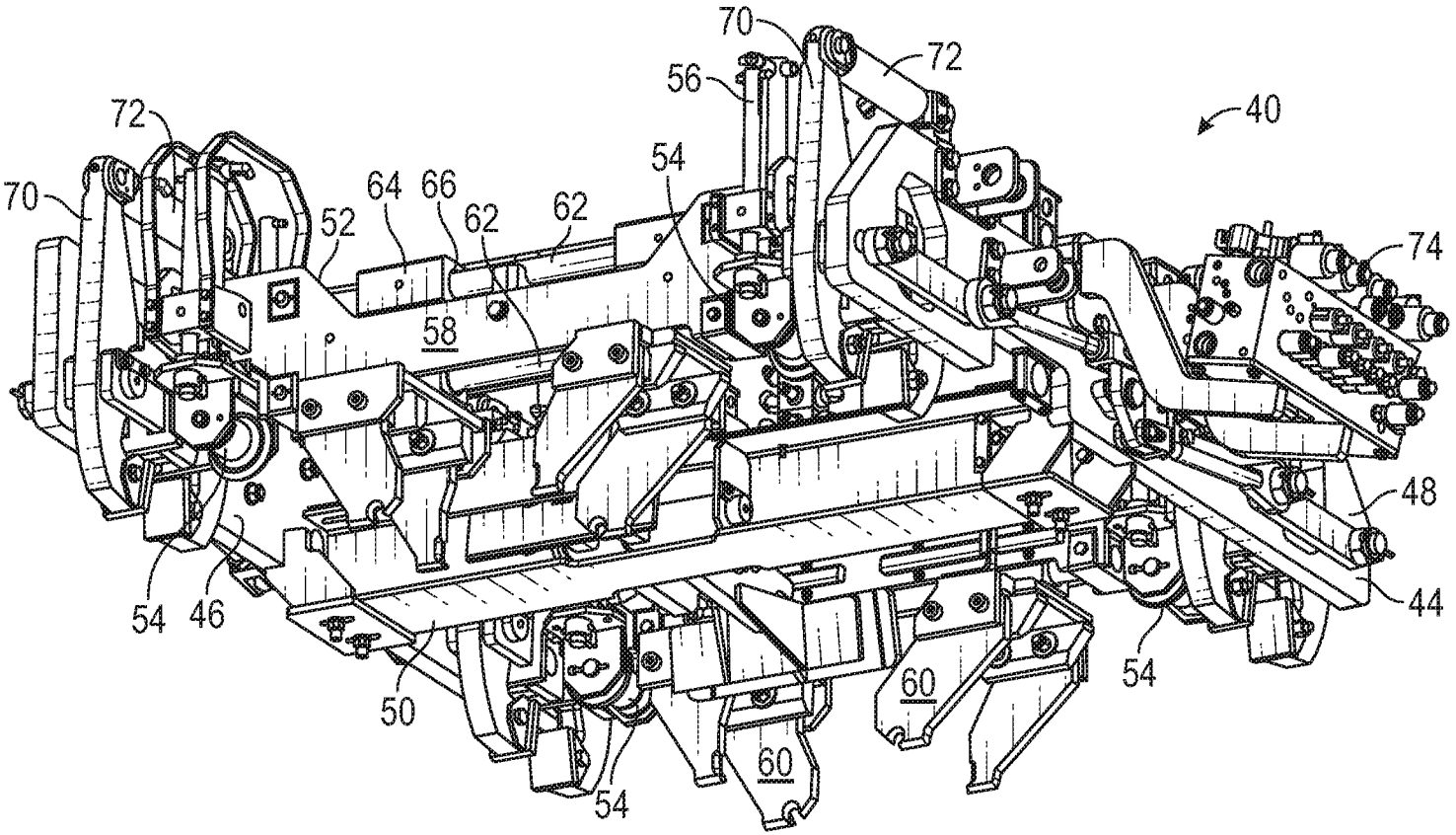
FIG. 3 is a fragmentary bottom perspective view of the workhead of FIG. 2.
Figure 4:
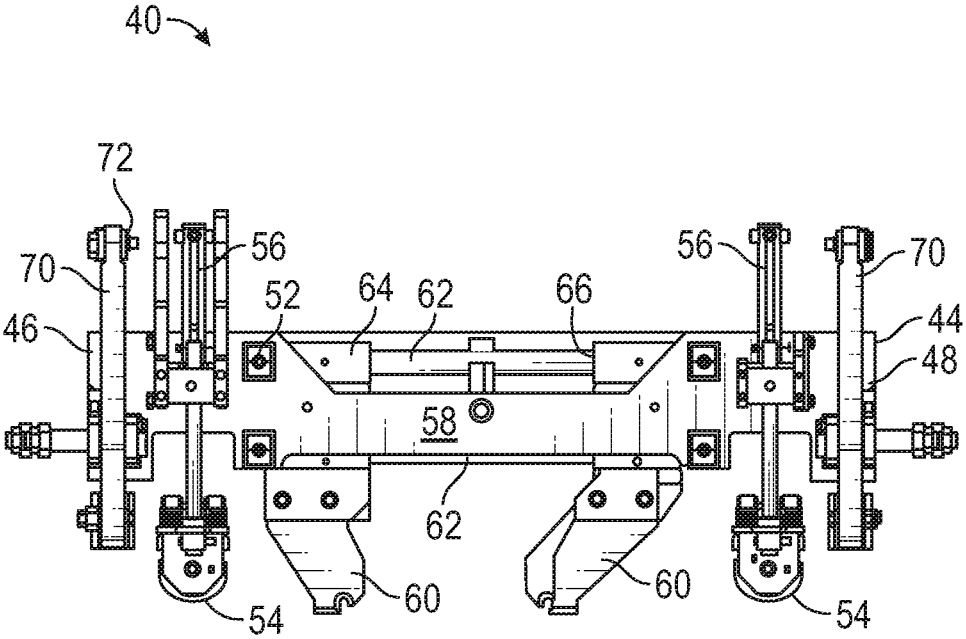
FIG. 4 is a side elevation of the present workhead depicting the guide wheels located in an extended position, raising the workhead to the travel position.
Figure 5:
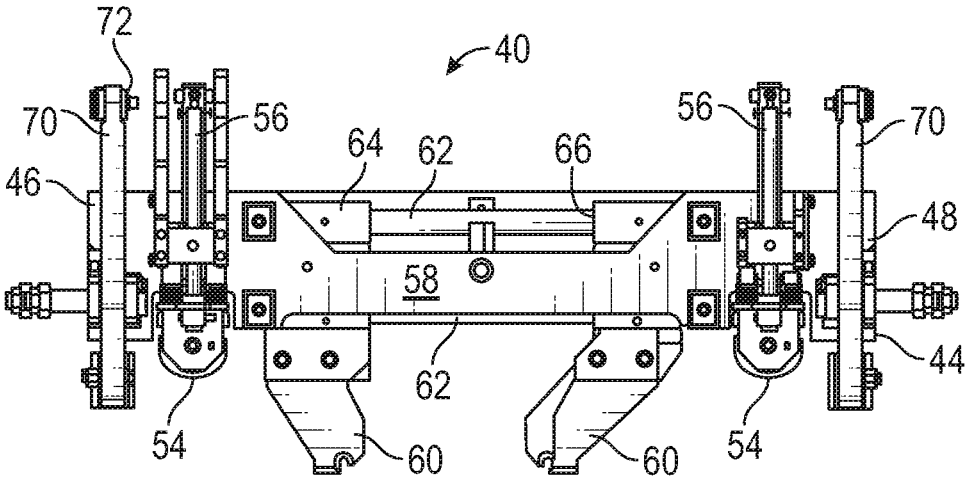
FIG. 5 is a side elevation of the present workhead depicting the guide wheels located in a retracted position, lowering the workhead to the working position.
Figure 6:
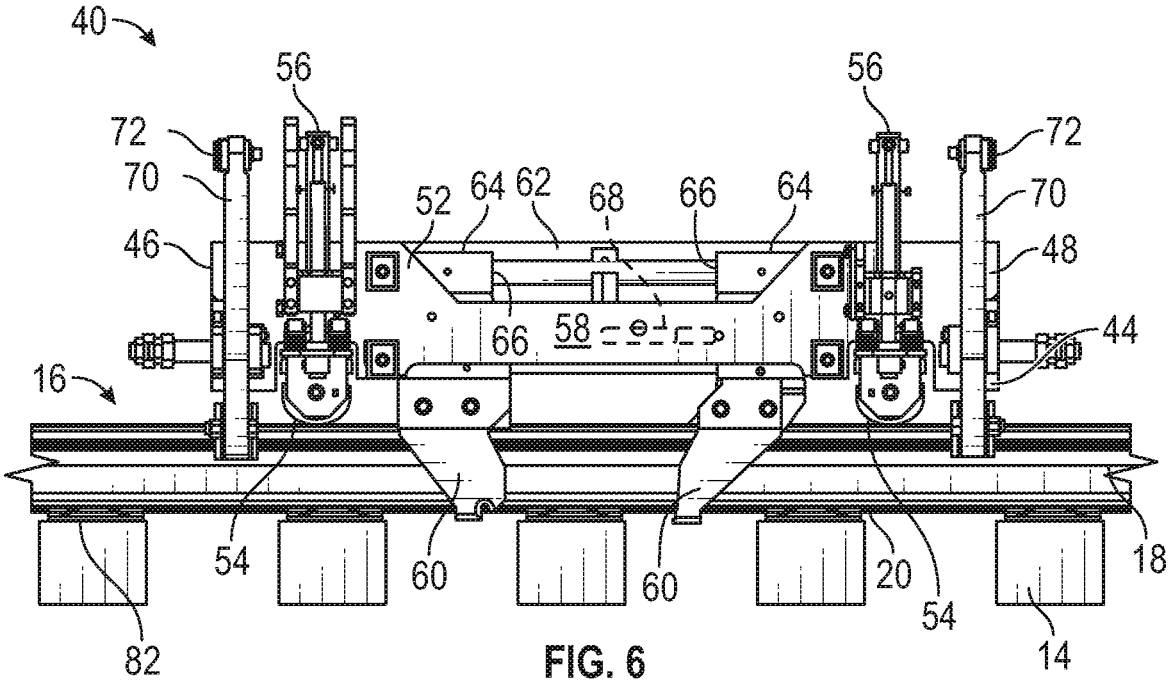
FIG. 6 is a side elevation of the present workhead depicting the tie plate gripping jaws in a release or open position.

Referring now to FIGS. 1-3, mounted to the tie exchanger 10, preferably in operational relationship to, or beneath the telescoping arm 24 is a plate retainer workhead, generally designated 40. A main purpose of the plate retainer workhead 40 is the grabbing and retaining of at least one target tie plate 20 on a target tie 14 slated for removal. The target tie plate 20 is retained by the workhead 40 against a foot or base 42 (FIG. 10) of the rail 18 during the tie extraction and replacement procedure.

Included on the workhead 40 is a workhead frame 44 configured for movement along the track 16 relative to the rail tie exchanger 10. A pair of main parallel, spaced front and rear frame members 46, 48 are parallel to the ties 14 and transverse to the rails 18, and are connected to a central beam 50 oriented to be parallel to the rails 18 to form a general "H" shape. Also included on the workhead frame 44 is a pair of plate retaining frames 52, each said plate retaining frame connected between the front and rear frame members 46, as by fasteners, and/or welding or the like, so that the plate retaining frames 52 move in unison with the workhead frame 44. Each plate retaining frame 52 is associated with a respective one of the rails 18, and extends along and above the rail.

Referring now to FIGS. 2-5, each plate retaining frame 52 has at least one and preferably a pair of preferably single-flanged rail guide wheels 54, each connected to the retaining frame using a fluid powered cylinder 56 mounted vertically to an outer side 58 of the retaining frame. The guide wheels 54 rotatably engage the rails 18. Through extension and retraction of the cylinders 56, the wheel 54 vertically reciprocate between a lowered or extended position, in which the workhead 40 is raised to a travel position (FIG. 4), and a raised or retracted position (FIG. 5), in which the workhead is lowered to a working position in operational relationship with at least one targeted rail tie plate 20.

Figure 7:
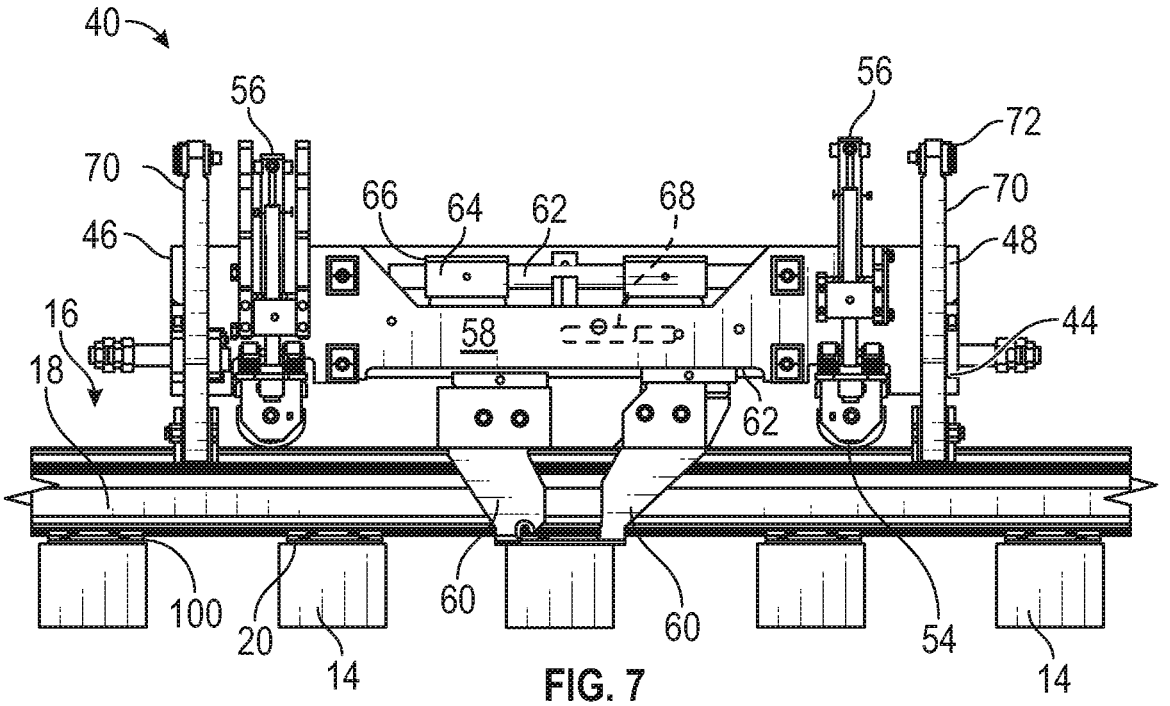
FIG. 7 is a side elevation of the present workhead depicting the tie plate gripping jaws in the plate clamping position.

Referring now to FIGS. 2, 3 and 6-7, another feature of the workhead 40 is at least one pair of opposed rail tie plate gripping jaws 60 connected to each plate retaining frame 52. Preferably four jaws 60 are associated with each tie plate 20, with one pair engaging the plate on the field side of the rail 18, and the other engaging the same plate on the gauge side of the rail. In operation, the jaws 60 reciprocate along a direction parallel to the rails 18 between a plate release position (FIG. 6) and a plate grabbing position (FIG. 7).

The reciprocating movement of the jaws 60 is enabled on each plate retaining frame 52 by a pair of spaced, parallel guide shafts 62 which are placed one above the other on a gauge side of the outer side 58. The jaws 60 each have a vertically-extending mount 64 with spaced sleeves 66 configured for slidably engaging the shafts 62. As is known in the art, the jaws 60 are moved between the plate release position and the plate grabbing position under operator control. Also, the use of the parallel guide shafts 62 has been found to significantly increase the control of the positioning of the grabbed plate 20 during the tie exchange process, compared to prior devices. Movement of the jaws 60 on the guide shafts 62 is accomplished with a fluid power cylinder 68 connected to each pair of opposing jaws. As is common to many rail maintenance apparatus, the workhead 40 is also provided with at least one, and preferably a pair of rail clamps 70, each operated by an associated fluid powered cylinder 72.

Figure 8:
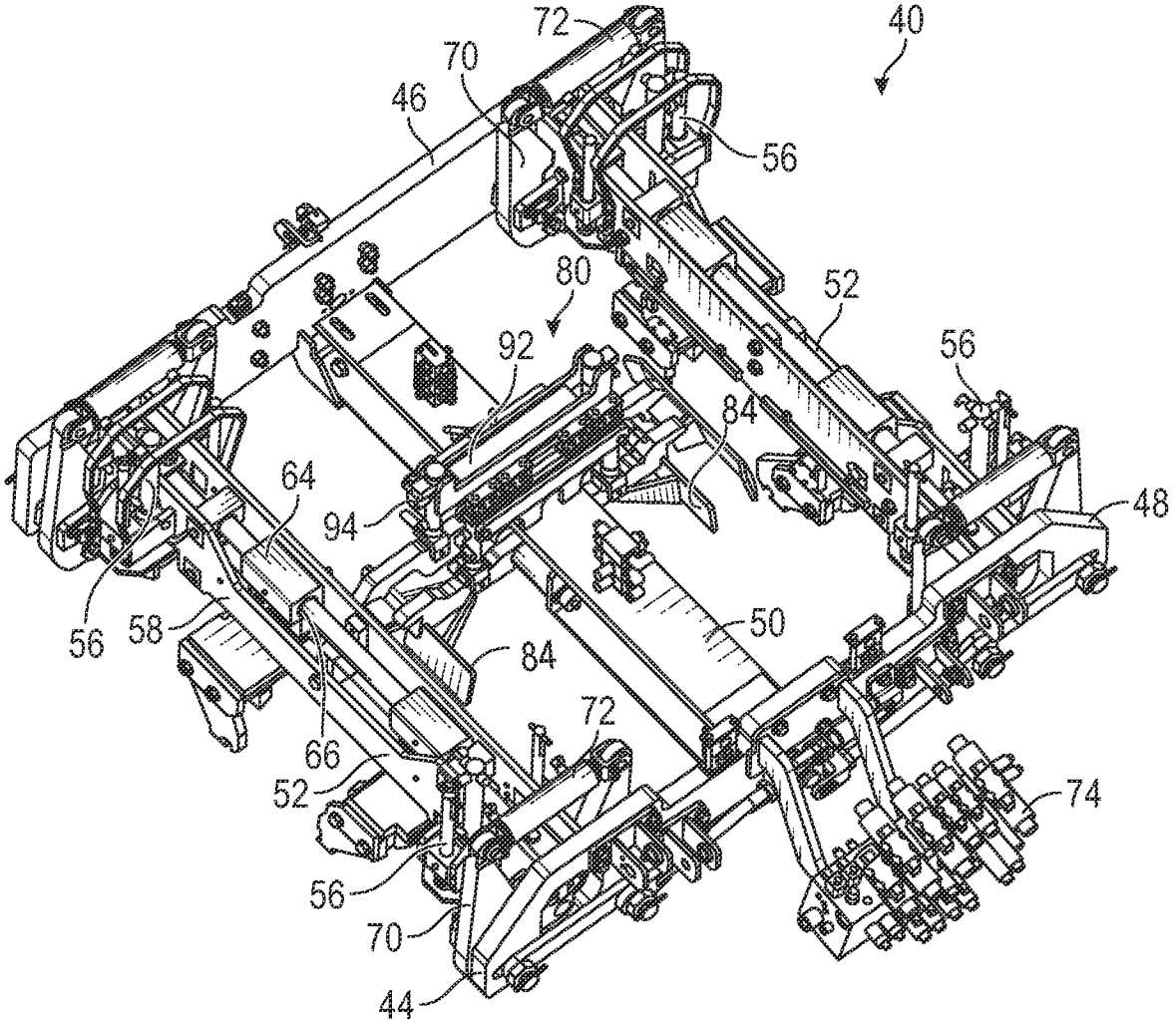
FIG. 8 is a top perspective view of the present workhead depicting the rail scraper assembly.
Figure 9:
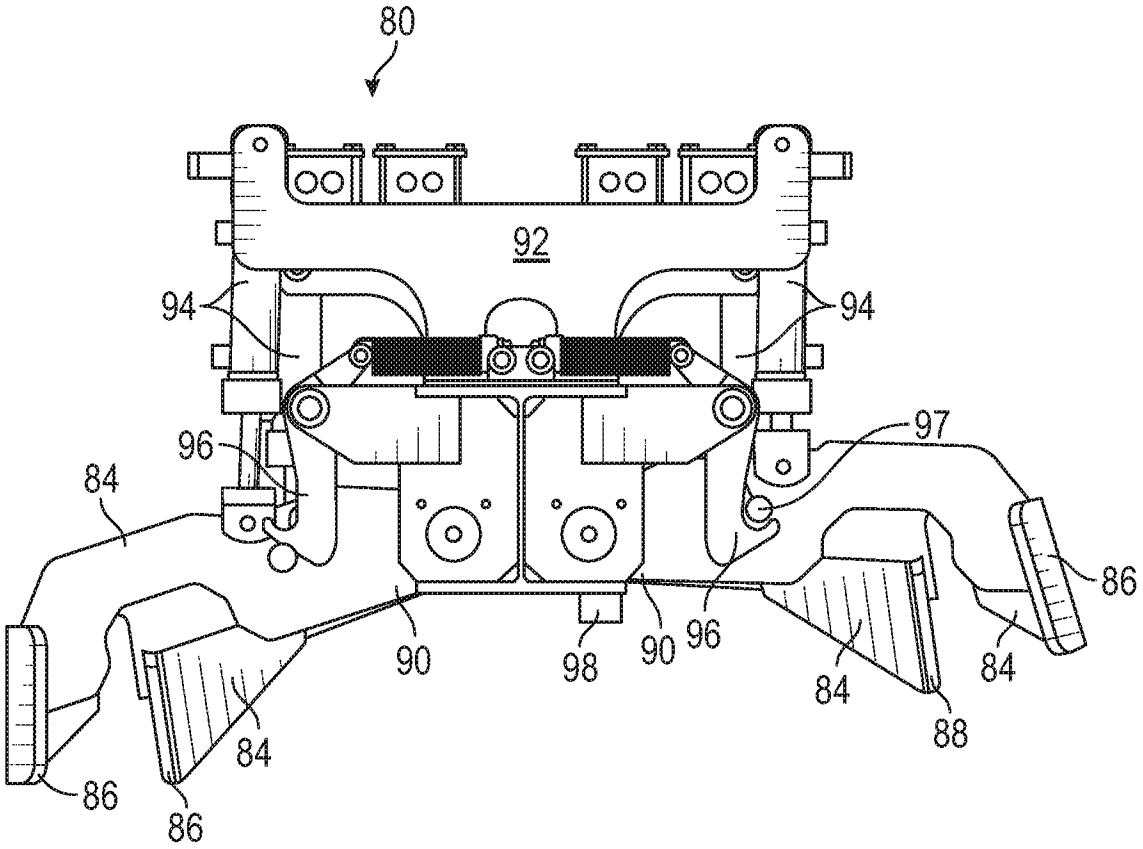
FIG. 9 is a fragmentary side elevation of the present rail scraper assembly.

Referring now to FIGS. 8 and 9, the workhead frame 44 is provided with a hydraulic control manifold 74 for connection of the various fluid power/hydraulic control lines for powering the various fluid-powered cylinders, and the association of those lines with appropriate valves and solenoids, which in turn are connected to the control system 32 as is well known in the art. Another feature of the present workhead 40 is a ballast scraper assembly 80 which is provided for removing stray ballast from an upper surface 82 (FIG. 6) of the newly inserted rail tie 14. Preferably mounted on the central frame beam 50, although other locations are contemplated, the ballast scraper assembly 80 features a plurality of independently movable scraper blades 84.

In the disclosed embodiment, each scraper blade 84 has a ballast engaging end 86 with a reinforced plate 88, and an opposite pivot end 90 connected to a scraper mount 92. As seen in FIG. 8, the scraper mount 92 is oriented to be parallel to the axis of the rail ties 14 and transverse to the rails 18 and to the plate retaining frames 52. Each scraper blade 84 is operated by an associated fluid power scraper cylinder 94 under operator control to vertically reciprocate relative to the tie surface 82. Also, spring-loaded scraper hooks 96 are provided to hold the scraper blades 84 suspended above the tie 14, through engagement with a corresponding blade lug 97 such as when the workhead 40 is traveling along the track 16 between worksites. When the scraper blades 84 are lowered into a working position by the scraper cylinders 94, as the new tie 14 is passed beneath the blades during insertion, the blades remove stray, unwanted ballast from the upper tie surface 82.

Another feature of the scraper assembly 80 is a linear variable differential transformer (LVDT) 98 (FIG. 9) for adjusting a height of the scraper blades 84 relative to a bottom surface 100 (FIG. 7) of a tie plate 20 grasped in the gripping jaws 60. In addition, the scraper blades 84 are also used for dislodging plates 20 caught or partially embedded in the tie 14.

Referring now to FIGS. 1, 10 and 11, another feature of the rail tie exchanger 10 is the ability to properly align a newly inserted tie 14, so that ends 102 of the ties are all in alignment. This ability is achieved through the use of a proximity switch 104 associated with an end 106 of the beam 26 that is closest to the arm 24. The switch 104 is connected to the control system 32.

A contact or flag 108 for the proximity switch 104 is located on the arm 24 and dimensioned so that upon the tie claws 12 pushing a newly installed tie 14 to a designated aligned position, the contact electrically closes the proximity switch, alerting the operator that the new tie is in a proper position. More specifically, the operator control interface 34 is connected to the fluid power cylinder 28 that is connected to the reciprocating arm for moving the arm relative to the beam between the extended position and the retracted position.

Upon the operator actuating the control interface 34, the fluid power cylinder 28 is constructed and arranged for retracting the arm 24, and the tie clamps 12, until the contact closes 108 the proximity switch 104. This action pushes the tie 14 into the proper position so that all of the tie ends 102 are in alignment (FIG. 11). In the preferred embodiment, in addition to closing the tie clamps 12, the operator actuation of the control interface 34 also causes the tie clamps to rotate towards the rails 18. Once the contact 18 closes the switch 104, the movement of the clamps 12 towards the rails 18 stops, since the tie 14 is in proper alignment.

While a particular embodiment of the present rail plate retainer with stabilized gripping jaws for use with a rail tie exchanger has been described herein, it will be appreciated by those skilled in the art that changes and modifications may be made thereto without departing from the invention in its broader aspects and as set forth in the following claims.

The invention claimed is:

1. A rail tie plate retaining workhead for use in conjunction with a rail tie exchanger moving along a railroad track having a pair of rails, said workhead comprising:

a workhead frame configured for movement along the track relative to the rail tie replacement machine;

a pair of plate retaining frames, each said plate retaining frame associated with a respective one of the rails, and being connected to said workhead frame;

each said plate retaining frame having at least one rail guide wheel connected to said retaining frame using a fluid powered cylinder, said wheels vertically reciprocating between an extended position, in which said workhead is raised to a travel position, and a retracted position, in which said workhead is lowered to a working position in operational relationship with at least one targeted rail tie plate; and a ballast scraper assembly mounted to said workhead frame between said plate retaining frames.

2. The rail tie plate retaining workhead of claim 1, further including a pair of opposed rail tie plate gripping jaws connected to each said plate retaining frame, said jaws being configured for reciprocating along a direction parallel to the rails between a plate release position and a plate grabbing position.

3. The rail tie plate retaining workhead of claim 2, wherein each said plate retaining frame has a pair of spaced, parallel guide shafts, and a pair of said jaws are slidable along said guide shafts between a plate release position and a plate grabbing position.

4. The rail tie plate retaining workhead of claim 1, wherein said ballast scraper includes vertically reciprocating scraper blades for engaging an upper surface of a tie being replaced.

5. The rail tie plate retaining workhead of claim 4, wherein said ballast scraper includes two pair of independently operating scraper blades.

6. The rail tie plate retaining workhead of claim 4, wherein said scraper blades are provided with an LVDT for adjusting a height of the blades relative to a bottom surface of a tie plate grasped in said gripping jaws.

7. The rail tie plate retaining workhead of claim 1, wherein said ballast scraper is oriented transversely to said plate retaining frames.

8. The rail tie plate retaining workhead of claim 1 further including a rail clamp associated with each said plate retainer frame.

9. A rail tie plate retaining workhead for use in conjunction with a rail tie replacement machine moving along a railroad track having a pair of rails, said workhead comprising:

a workhead frame configured for movement along the track relative to the rail tie replacement machine;

a pair of plate retaining frames, each said plate retaining frame associated with a respective one of the rails, and being connected to said workhead frame;

a pair of opposed rail tie plate gripping jaws connected to each said plate retaining frame, said jaws being configured for reciprocating along a direction parallel to the rails between a plate release position and a plate grabbing position, wherein each said plate retaining frame has a pair of spaced, parallel guide shafts, and a pair of said jaws are slidable along said guide shafts between a plate release position and a plate grabbing position; and a ballast scraper assembly mounted to said workhead frame between said plate retaining frames.

10. The rail plate retaining workhead of claim 9, wherein each said plate retaining frame has at least one rail guide wheel connected to said retaining frame using a fluid powered cylinder, said wheels vertically reciprocating between an extended position, in which said workhead is raised to a travel position, and a retracted position, in which said workhead is lowered to a working position in operational relationship with at least one targeted rail tie plate.

11. The rail tie plate retaining workhead of claim 10, wherein said ballast scraper includes vertically reciprocating scraper blades for engaging an upper surface of a tie being replaced.

12. The rail tie plate retaining workhead of claim 11, wherein said ballast scraper includes two pair of independently operating scraper blades.

13. The rail tie plate retaining workhead of claim 11, wherein said scraper blades are provided with an LVDT for adjusting a height of the blades relative to a bottom surface of a tie plate grasped in said gripping jaws.

14. The rail tie plate retaining workhead of claim 10, wherein said ballast scraper is oriented transversely to said plate retaining frames.

15. The rail tie plate retaining workhead of claim 9 further including a rail clamp associated with each said plate retainer frame.

* * * * *